US006009839A

United States Patent [19]

Kohn

[11] Patent Number: 6,009,839

[45] Date of Patent: Jan. 4, 2000

[54] CHILD RESTRAINT HARNESS

[76] Inventor: Kevin M. Kohn, 2276 Shasta Way, Atlanta, Ga. 30345

[21] Appl. No.: 09/149,497

[22] Filed: Sep. 8, 1998

[51] Int. Cl.[7] ..... A62B 35/00

[52] U.S. Cl. ..... 119/770; 119/856; 119/857; 224/160; 224/161; 297/465

[58] Field of Search ..... 119/712, 770, 119/856, 857, 858, 907; 182/3, 4; 244/151 R; 224/159, 160, 161, 638; 297/464, 465, 467

[56] References Cited

U.S. PATENT DOCUMENTS

| | | | |
|---|---|---|---|
| 1,271,176 | 7/1918 | Kureczka . | |
| 1,684,110 | 9/1928 | Pickels | 119/770 |
| 3,162,343 | 12/1964 | Anderson | 244/160 |
| 4,226,474 | 10/1980 | Rupert et al. | 297/484 |
| 4,537,154 | 8/1985 | Kay | 119/857 |
| 4,560,097 | 12/1985 | Reynolds et al. | 224/160 |
| 4,667,624 | 5/1987 | Smith | 119/770 |
| 4,848,793 | 7/1989 | Huspen et al. | 280/801 |
| 5,119,767 | 6/1992 | Jimenez | 119/96 |
| 5,259,338 | 11/1993 | Cornell | 119/770 |
| 5,325,818 | 7/1994 | Leach | 119/770 |
| 5,388,551 | 2/1995 | Martusciello | 119/770 |
| 5,540,403 | 7/1996 | Standley | 244/122 B |
| 5,562,326 | 10/1996 | Stroud | 297/465 |
| 5,619,955 | 4/1997 | Nelson | 119/857 |
| 5,628,548 | 5/1997 | Lacoste | 397/484 |
| 5,676,426 | 10/1997 | Herring | 297/484 |
| 5,678,739 | 10/1997 | Darling et al. | 224/160 |
| 5,730,498 | 3/1998 | Hanson et al. | 397/465 |
| 5,732,861 | 3/1998 | Jakobson | 224/160 |
| 5,733,014 | 3/1998 | Murray | 297/485 |
| 5,848,741 | 12/1998 | Fair | 224/160 |
| 5,909,927 | 6/1999 | Henshall | 297/468 |
| 5,927,235 | 7/1999 | Olaiz | 119/770 |

FOREIGN PATENT DOCUMENTS

| | | | |
|---|---|---|---|
| 4401702 | 8/1994 | Germany | 297/465 |

*Primary Examiner*—Peter M. Poon
*Assistant Examiner*—Judith A. Nelson
*Attorney, Agent, or Firm*—Joseph N. Breaux

[57] ABSTRACT

A child restraint harness system comprising a first harness assembly securable about the legs and shoulders of a child and including a semi rigid child seat frame having harness retention clips securable to a second harness assembly worn by an adult. The restraint harness is particularly suitable for restraining a child in the lap of an adult while riding in an airplane.

3 Claims, 2 Drawing Sheets

CHILD RESTRAINT HARNESS

TECHNICAL FIELD

The present invention relates to devices and methods for child restraints and more particularly to devices and methods for a child restraint harness system comprising a first harness assembly securable about the legs and shoulders of a child which includes a semi ridged seat frame assembly having harness retention clips securable to a harness assembly worn by an adult. The child restrain harness is particularly suitable for securing a child while riding in an airplane.

BACKGROUND ART

There have been many child safety harnesses and restraint harnesses designed to restrain children for numerous situations. These products are extremely useful for their stated purposes however the prior art fails to provide a device as the present which is particularly suited for securing a child while riding in an airplane. As many air travelers have experienced, airliners do not provide a securing harness tor infants and the child's parents are required to hold the child in their lap. The present invention includes two harness assemblies, one for a child and the other mating harness worn by an adult. The combination of securing harnesses allows an adult to securely restrain his/her child while also supporting the child in a posture which is particularly suitable for turbulence experienced on airplanes.

The prior art patents are as follows:

Himenez, U.S. Pat. No. 5,119,767 discloses a child safety device. This device is useful for its stated purposes however it does not provide a restraint harness which secures a child to his/her parent as needed while riding in an airplane.

Huspen, et al, U.S. Pat. No. 4,848,793 discloses a child safety restraining vest which is useful in automobiles and other vehicles having lap belt restraining systems. This device is also useful for its stated purposes however it does not provide a securing means as the present which not only secures a child to his or her parents but also supports the child's upper torso while being restrained.

Herring, U.S. Pat. No. 5,616,426 discloses a safety harness comprising a waist strap replacement around the waist of a child along with shoulder straps and an anchor strap. This device is also useful for its stated purpose that it does not provide a system for securing a child to a parent as the present invention.

Standley, U.S. Pat. No. 5,540,403 discloses an airplane seat child safety harness comprising a central buckle formed in a planar configuration and including a coupling device adaptable to be coupled with a seat belt buckle inserts. This device is useful for strapping a child to an existing airplane seat belt however the inventor has found that providing a child with a restraint harness which is attachable to a harness worn by a parent provides a system which not only securely restrains the child but also supports the child's upper torso during turbulent airplane rides.

Cornell, U.S. Pat. No. 5,259,338 discloses a safety harness for children with a tether line attachable to a parent. This device is useful for restraining a child while walking it does not provide a system as the present for restraining a child while seated in an airplane.

Rupert, et al, U.S. Pat. No. 4,226,474 discloses a safety vest worn by a person to be secured to a seat at four points. This device is useful however it does not provide a mating harness as the present for securing the safety vest to a parent as the present invention.

As can be seen from the prior art there has never been an invention as the present which provides a child restraint harness comprising a first harness securable about the legs and shoulders of a child and which includes a semi ridged child seat and frame work having harness retention clips securable to a harness assembly worn by an adult. The present invention is particularly adaptable for use while riding in an airplane while the child is restrained and secured in position the child's upper torso is also supported by a semi ridged child seat frame work and the securing straps positioned at the torso end of the restraint harness.

GENERAL SUMMARY DISCUSSION OF INVENTION

It is thus an object of the invention to provide a Child Restraint Harness that is particularly suitable for restraining a child in a lap of an adult while riding an in airplane.

It is a further object of the invention to provide a Child Restraint Harness that securely restrains a child in the lap of an adult and also supports the child upper torso while being restrained by the use of a semi ridged child seat frame and securing straps positioned at the torso end of the restraint harness.

It is a further object of the invention to provide a Child Restraint Harness that comprises a first harness assembly secured about the legs and shoulders of a child and including a semi ridged child seat frame work having harness retention clips which are securable to a second harness assembly worn by an adult which is securable about the chest of the adult.

Accordingly, a Child Restraint Harness is provided for securing a child in the lap of an adult while riding in an airplane wherein the child restraint harness comprises two harnesses, wherein a first harness assembly is securable about the legs and shoulders of a child and includes a semi ridged child seat frame work including a back portion extending from the child's neck area to the child's bottom while a semi flexible seat portion with leg cut-outs wrap around the baby's bottom and secures the child in place by a retention strap extending over the child's shoulders to the seat portion, a second harness is worn by an adult and secured by chest straps and providing retention clips securable to the child restraint harness at a location near the top torso part of the child restraint harness and at a point near the seat bottom of the child's restrain harness.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that one who may need to securely restrain a small child, such as when encountering turbulence on an air craft, would simply attach the adult harness component of the restraint harness around the adult's body with the longitudinal straps encircling the adult's thoracic cavity and securing the straps with the quick release retention clips. The adult would then place the child restraint harness onto the infant by first wrapping the semi-rigid seat member around the child's bottom and securing the seat member to the shoulder strap which extend from a semi-rigid back member over the child's shoulder and to the seat member. The adult would then attach the infant along with the infant restraint harness to the adult harness by clipping the side mounted retention clips on the child's harness to the adult's harness, the child would be positioned with his/her back to the parent's front while a smaller baby may be placed facing the parent if desired. The adult would then enjoy the benefits of having their infant securely restraint in a manner which will prevent a possible accident or injury from sudden and unexpected turbulence while riding in an aircraft.

Figure 1:
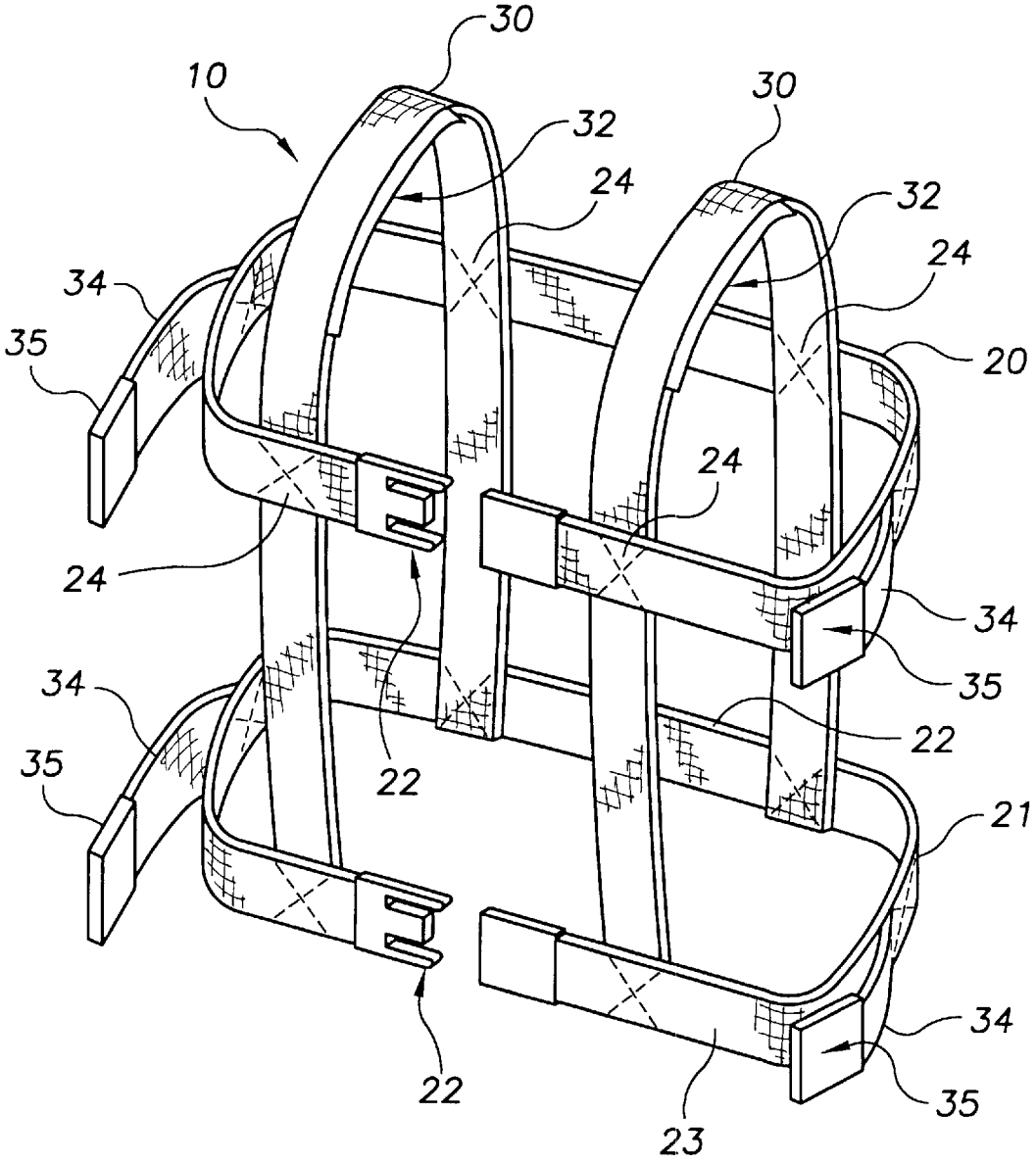
FIG. 1 is an isometric view of the harness assembly worn by an adult.

Referring to the figures in detail, FIG. 1 illustrates the harness used on the adult 10 which includes a pair of longitudinal straps which extend around the adult's thoracic cavity. The longitudinal straps include an upper longitudinal strap 20 which extends around an upper portion of the adult's thoracic cavity, while a lower longitudinal strap 22 extends around the adult's thoracic cavity near the abdominal area. The longitudinal straps are adjusted and secured utilizing retention clips 22 which are positioned on a front portion of the adult harness so that the clips are easily accessed by the user. A pair of shoulder straps 30 extend from a back portion 22 of the lower longitudinal strap 21. The shoulder straps then extend upwardly and over the user's shoulders and downwardly across the user's chest area and are fixedly secured to a front portion 23 of the lower longitudinal strap 21. The shoulder straps 30 are further fixedly secured to the upper longitudinal strap 20 at locations 24. The straps are preferably connected to each other by stitching. The shoulder straps further include a padded section 32 which rest on a user's shoulders. Two pairs of retention clips 35 are attached to the longitudinal straps utilizing short strap portions 34. The retention clips 35 and short strap sections 34 are preferably attached to the longitudinal strap at a location near the user's side. The retention clips 35 are preferably quick release retention clips which provides an easy release mechanism for removing the child harness as will be described below.

Figure 2:
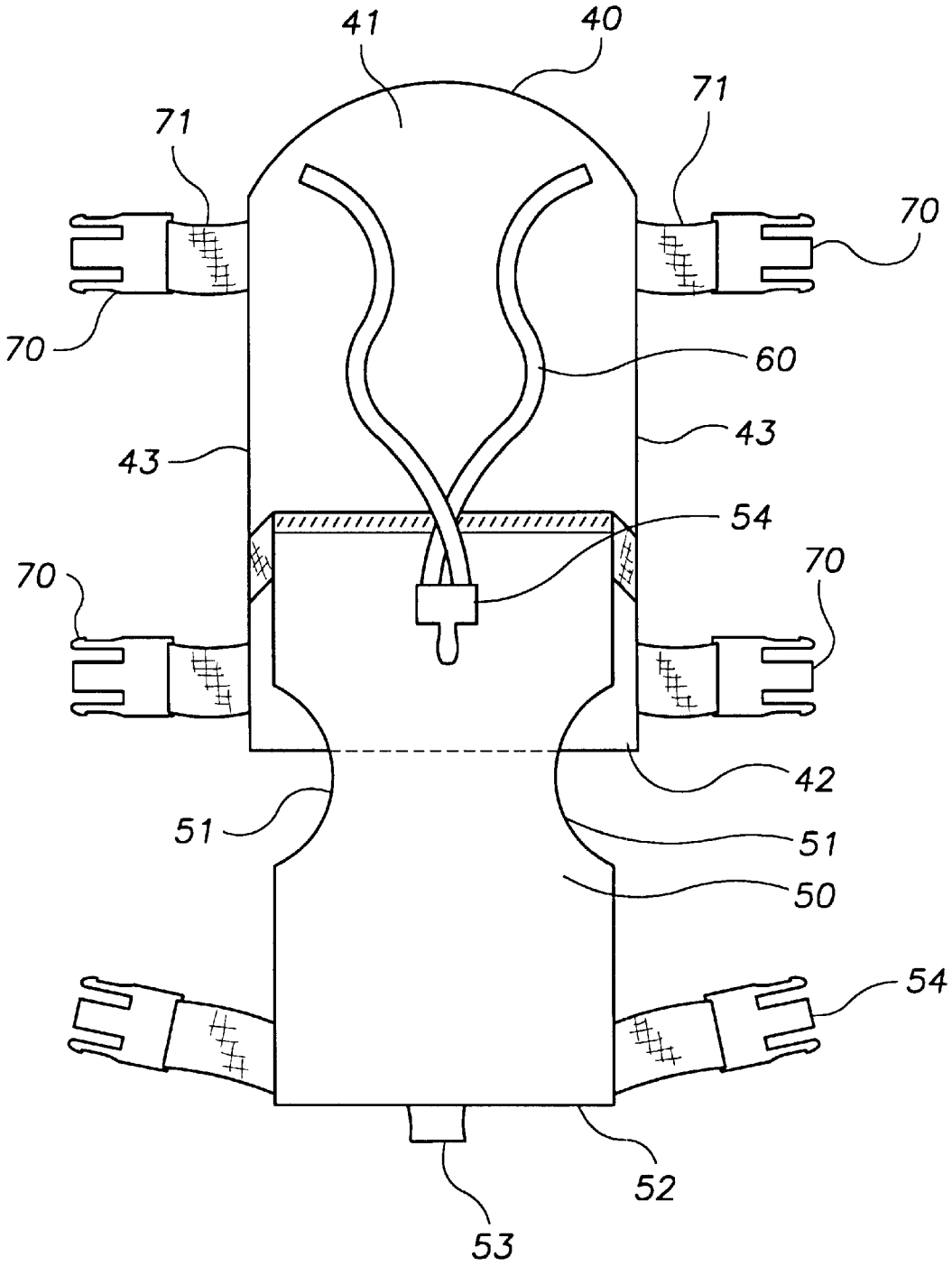
FIG. 2 is a frontal view of the child restraint harness comprising the semi rigid back portion, and the semi flexible seat frame with leg cut-outs and retaining clips positioned for retention of the child restraint harness to the adult harness.

The child restraint harness is illustrated in FIG. 2 and includes a semi-rigid back portion 40, and a semi-rigid seat portion 50. The child harness is designed so that a child may either be placed with the back portion facing the child's front or with the back portion facing the child's back. Preferably smaller children are positioned to face their parents when positioned in the harness system. Larger children may be placed facing away from their parents. The harness described herein provides an apparatus for positioning a child in either orientation. The semi-rigid back support 40 includes a curved top section 41 which preferably extends to a lower neck portion of the child and a bottom end 42 which extends to a lower back section of the child. The semi-rigid seat member 50 is attached near the bottom end 42 of the back section 40 and includes two indentions on opposing sides 51 which are used to insert the legs of the child when the top edge 52 of the semi-rigid seat member is wrapped around the child's bottom and connected to the shoulder harness 60 utilizing retention clip 53. The semi-rigid seat member should be flexible enough to wrap around the child while providing comfort to the child. A wrap around waist strap 54 is optionally provided to further secure the seat member once positioned around the child's bottom. The optional strap 54 extends around the back member and is secured thereby preventing the fold up seat member from falling if the shoulder strap becomes disconnected. Two pairs of retention clips 70 extend from long sides 43 of the semi-rigid back member by short retention clip straps 71. The two pairs of retention clips 70 are used to mate with and attach to the two pairs of retention clips 35 which are attached to the adult harness 10. The retention clips 70 are also preferably quick released clips so that the adult may quickly release the child from the harness if desired. The shoulder strap 60 extends from the upper end 41 of the semi-rigid back member and extends over the child's shoulders and is adjustable in length and connectable to retention clip 53 by a male member 54. The semi-rigid back member 40 and the semi-rigid seat member 50 are preferably constructed of water proof nylon material with a semi-rigid core which allows for flexibility but also some structural integrity to help support the child when positioned in a harness.

It is noted that the embodiment of the Child Restraint Harness described herein in detail for exemplary purposes is of course subject two many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A child restraint harness comprising:

a) a child restraint harness securely attachable to a child desired to be restrained comprising a semi-rigid back framework which has a top end positioned near the child's neck and two long sides which extend downwardly to the child's bottom while a semi-rigid seat which extends from a bottom end of the semi-rigid back framework and wraps around a child's legs to a front abdominal area of the child and is secured in position by a securing strap which includes a pair of straps attached to the top end of the semi-rigid back framework and extend over the child's shoulders and connect to the semi-rigid seat framework positioned in the front abdominal area of the child, two pair of retention clips attached and extending from the, two log sides of the semi-rigid framework while one pair of retention clips are positioned near the top end of the semi-rigid back framework and another pair of retention clips are positioned near the bottom end of the semi-rigid back framework, b) a second harness worn by an adult comprising a pair of longitudinally positioned straps around the thorax of the adult with an upper strap positioned around the upper thorax area and a lower strap positioned around the middle thoracic area each strap being fitted with quick release buckles, a pair of shoulder straps each extending from the lower strap on the adults back and extending over the adult's shoulders and connecting to the lower strap on the adult's front side, the shoulder straps are fixedly secured to the upper and lower strap on both the back and front of the adult, two pair of retention clips positioned on the upper and lower strap on the front side of the adult harness and positioned to align with the pair of retention clips on the child restraint harness.

2. The child restraint harness of claim 1, wherein said back framework further comprises a cloth back framework with a flexible inner core material which provide the semi-rigid back for supporting the back of the child.

3. The child restraint harness of claim 1, wherein the pair of retention clips on the child restraint harness and the pair of retention clips on the second harness further comprises retention clips which are quick release retention clips.

* * * * *